US008105121B2

(12) United States Patent
Miyamoto et al.

(10) Patent No.: US 8,105,121 B2
(45) Date of Patent: Jan. 31, 2012

(54) GROUND TERMINAL FITTING WITH A CLAMPING SECTION TOUCHING A GROUND MEMBER

(75) Inventors: Kenji Miyamoto, Yokkaichi (JP); Tetsuji Tanaka, Yokkaichi (JP); Hiroki Hirai, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 162 days.

(21) Appl. No.: 12/733,565

(22) PCT Filed: Oct. 31, 2008

(86) PCT No.: PCT/JP2008/069909

§ 371 (c)(1),
(2), (4) Date: Mar. 9, 2010

(87) PCT Pub. No.: WO2009/060800

PCT Pub. Date: May 14, 2009

(65) Prior Publication Data

US 2010/0197179 A1 Aug. 5, 2010

(30) Foreign Application Priority Data

Nov. 6, 2007 (JP) ..... 2007-288288

(51) Int. Cl.
*H01R 11/11* (2006.01)

(52) U.S. Cl. ..... 439/883

(58) Field of Classification Search ..... 439/883, 439/889, 108, 287, 288; 174/84 C
See application file for complete search history.

(56) References Cited

U.S. PATENT DOCUMENTS 5,577,927 A 11/1996 Okada et al.
5,672,442 A * 9/1997 Burnett ..... 429/121
6,530,795 B2 * 3/2003 Maeda et al. ..... 439/287
7,125,295 B2 * 10/2006 Zhao et al. ..... 439/883
7,867,044 B2 * 1/2011 Lee ..... 439/883
2004/0040734 A1 3/2004 Fujii et al.

FOREIGN PATENT DOCUMENTS

JP U-7-36371 7/1995
JP A-2002-260754 9/2002
JP A-2004-31226 1/2004
JP A-2004-139932 5/2004

OTHER PUBLICATIONS

Dec. 22, 2008 Search Report issued in International Patent Application No. PCT/JP2008/069909 (with translation).

* cited by examiner

*Primary Examiner* — Chandrika Prasad
(74) *Attorney, Agent, or Firm* — Oliff & Berridge, PLC

(57) ABSTRACT

The present invention provides a ground terminal fitting capable of being fixed to a ground member through a simple operation while permitting production cost to be reduced, and a ground device having the ground terminal fitting. The ground terminal fitting comprises a terminal body surrounding a through-hole, a clamping piece having a rising portion rising from an outer peripheral edge of the terminal body and a distal end portion extending inwardly from the rising portion along the terminal body, and a clampable piece located adjacent to the clamping piece in a circumferential direction of the terminal body. The clamping piece is adapted to clamp, when the ground terminal fitting is superimposed on a second ground terminal fitting, a clampable piece of the second ground terminal fitting to prevent a relative displacement between the ground terminal fittings. The distal end portion is adapted to contact the ground member penetrating through the through hole to prevent a relative rotation of the ground terminal fitting with respect to the ground member.

9 Claims, 6 Drawing Sheets

GROUND TERMINAL FITTING WITH A CLAMPING SECTION TOUCHING A GROUND MEMBER

TECHNICAL FIELD

The present invention relates to a ground terminal fitting for establishing a ground connection in a vehicle, and a ground device having the ground terminal fitting.

BACKGROUND ART

As a structure for establishing a grounding connection in a vehicle, there has been known one type in which a plurality of ground terminal fittings are fastened to respective ends of a plurality of grounding cables included in a wire harness for a vehicle, the ground terminal fittings adapted to be fixed to a common ground member provided on a vehicle body while being superimposed on each other.

For example, the following Patent Document 1 discloses a ground terminal fitting which comprises a pair of barrel-shaped walls making up a cable-fastening section adapted to be fastened to an end of an electric cable, and a plurality of clamping sections each rising in the same direction as that of the barrel-shaped walls: the clamping sections are adapted to clamp a clampable section of a second ground terminal fitting superimposed on the first ground terminal fitting to prevent a relative displacement between the superimposed ground terminal fittings. Furthermore, the ground terminal fitting to be disposed at a lowermost position includes, in addition to the clamping section, an anti-rotation piece extending in a direction opposite to the rising direction of the barrel-shaped walls, the anti-rotation piece adapted to be engaged with a groove formed in a ground member to prevent the lowermost ground terminal fitting from being rotated with respect to the ground member.

Since the grounding structure disclosed in the cited Document 1 includes two types of ground terminal fittings, one having both the clamping section and the anti-rotation piece and the other having only the clamping section, superimposing these ground terminal fittings on each other requires distinguishing between the types of ground terminal fittings and determining an order of superimposing the plurality of ground terminal fittings so as to let the ground terminal fitting having the anti-rotation piece be attached to the ground member. This complicates an operation of fixing each of the ground terminal fittings to the ground member. Moreover, the use of the two types of ground terminal fittings involves burdensome parts management and an increased production cost.

[Patent Document 1] JP 2002-260754A

SUMMARY OF THE INVENTION

In view of the above circumstances, it is an object of the present invention to provide a ground terminal fitting capable of being fixed to a ground member by a simple operation, and permitting production cost to be reduced.

To achieve this object, the present invention provides a ground terminal fitting designed to be fixed to a common ground member together with another ground terminal fitting in a mutually superimposed manner: the ground terminal fitting comprises an annular-shaped terminal body formed with a through-hole for allowing the ground member to penetrate therethrough; a cable-fastening section having a bottom wall, and a pair of barrel-shaped walls each rising from the bottom wall, the cable-fastening section being adapted to perform plastic deformation to let the cable-fastening section be fastened to an end of an electric cable; a clamping section having a rising portion rising from an outer peripheral edge of the terminal body in a direction opposite to that of the barrel-shaped walls of the cable-fastening section, and a distal end portion extending from the rising portion inwardly along the terminal body; and a clampable section formed along the outer peripheral edge so as to be located adjacent to the clamping section in a circumferential direction of the terminal body. The clamping section is adapted to clamp, when the ground terminal fitting is superimposed on a second ground terminal fitting, a clampable section of the second ground terminal fitting to prevent a relative displacement between the superimposed ground terminal fittings. The distal end portion of the clamping section is adapted to touch, when the ground member is set to penetrate through the through-hole, the ground member to prevent the ground terminal fitting having the clamping section from being rotated with respect to the ground member.

The present invention also provides a ground device which comprises a plurality of the above ground terminal fittings formed in a same configuration and adapted to be superimposed on each other to form a superimposed assembly, and a common ground member being provided on a given support base and having a portion adapted to be inserted into respective through-holes of the ground terminal fittings included in the superimposed assembly, wherein the ground member has a portion adapted to be engaged with the clamping section of a lowermost one of the ground terminal fittings in the superimposed assembly to prevent a rotation of the lowermost ground terminal fitting.

DETAILED DESCRIPTION OF THE EMBODIMENTS OF THE INVENTION

With reference to the drawings, a most preferred embodiment of the present invention will now be specifically described.

Figure 1:
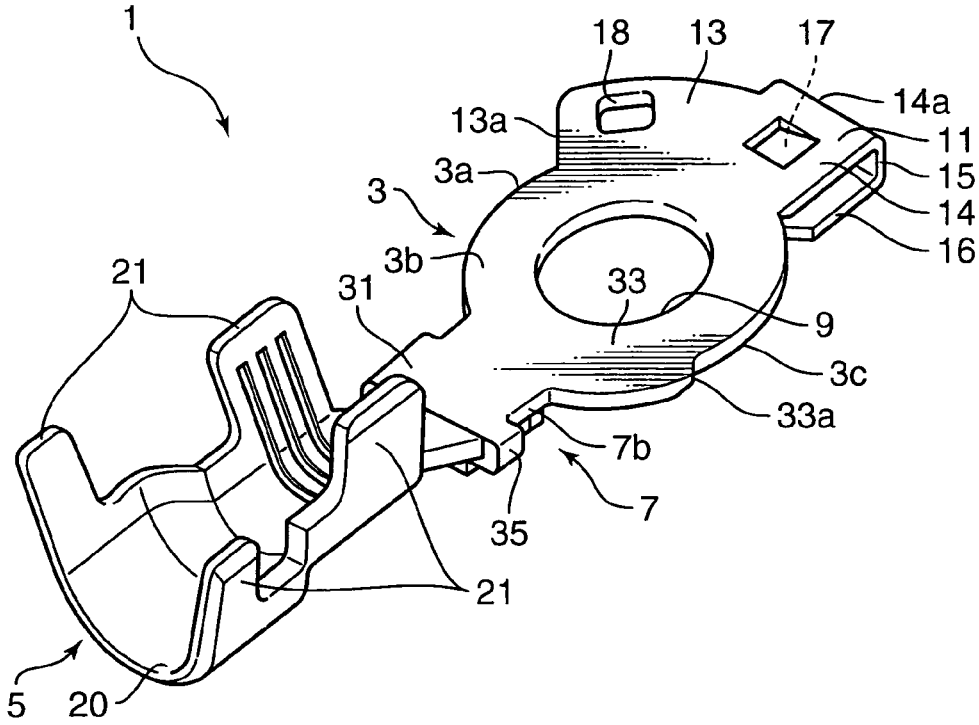
FIG. 1 is a perspective view of a ground terminal fitting according to the present invention.
Figure 10:
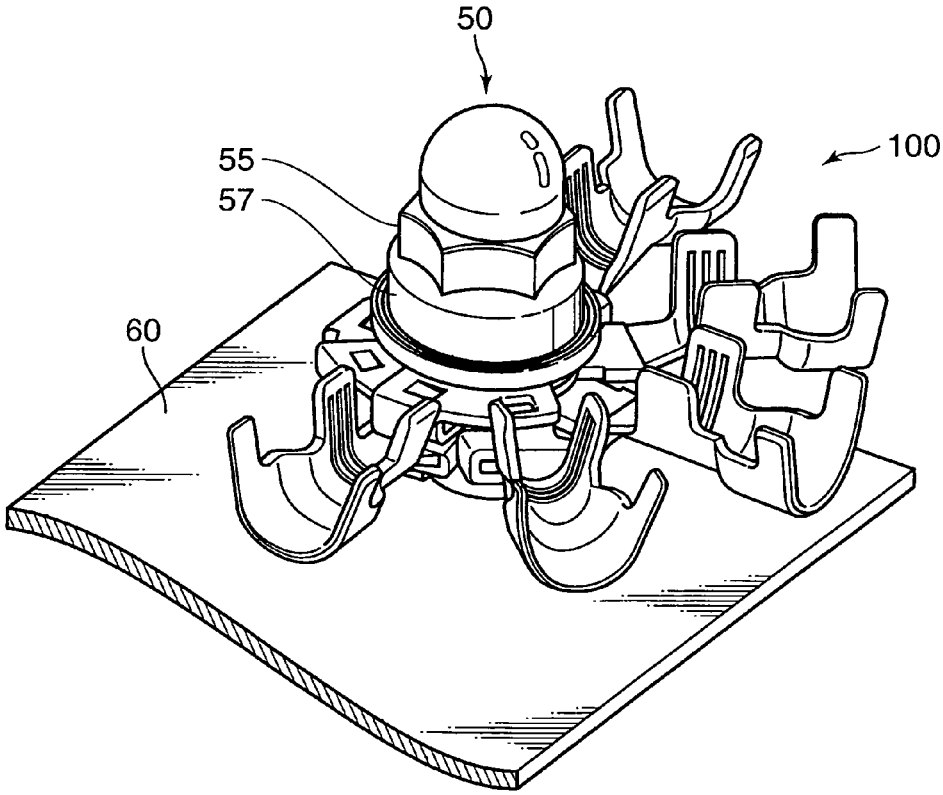
FIG. 10 is a perspective view showing the superimposed assembly shown in FIG. 8 be fixed to the ground member.

FIG. 1 is a perspective view of a ground terminal fitting 1 according to one embodiment of the present invention. The ground terminal fitting 1 is designed to be connected, for example, to a grounding cable (not shown) included in a wire harness for a vehicle. This ground terminal fitting 1 is adapted to be superimposed on a second ground terminal fitting 1 having the same configuration as that thereof, on each other in a multilevel manner, to form a superimposed assembly 100 as shown in FIG. 10; the superimposed assembly 100 is fixed to a common ground member 50 provided on a support base, such as a vehicle body.

The ground terminal fitting 1, which is formed by bending a flat-shaped metal plate punched out in a given shape, comprises a terminal body 3, a cable crimp section 5 adapted to be crimped onto a grounding cable, and a neck section 7 connecting the terminal body 3 and the cable crimp section 5.

The terminal body 3 is formed in an annular shape of surrounding a circular-shaped through-hole 9, into which a shaft portion 51 of the ground member 50 is inserted as described later with reference to FIG. 8. The terminal body 3 has an outer peripheral edge 3*a* with a circular shape concentric with the through-hole 8. The ground terminal fitting 1 further comprises a first clamping piece (clamping section) 11 and a first clampable piece (clampable section) 13 extending continuously from the first clamping piece 11 in a circumferential direction of the terminal body, the pieces formed along the outer peripheral edge 3*a*.

Figure 2:
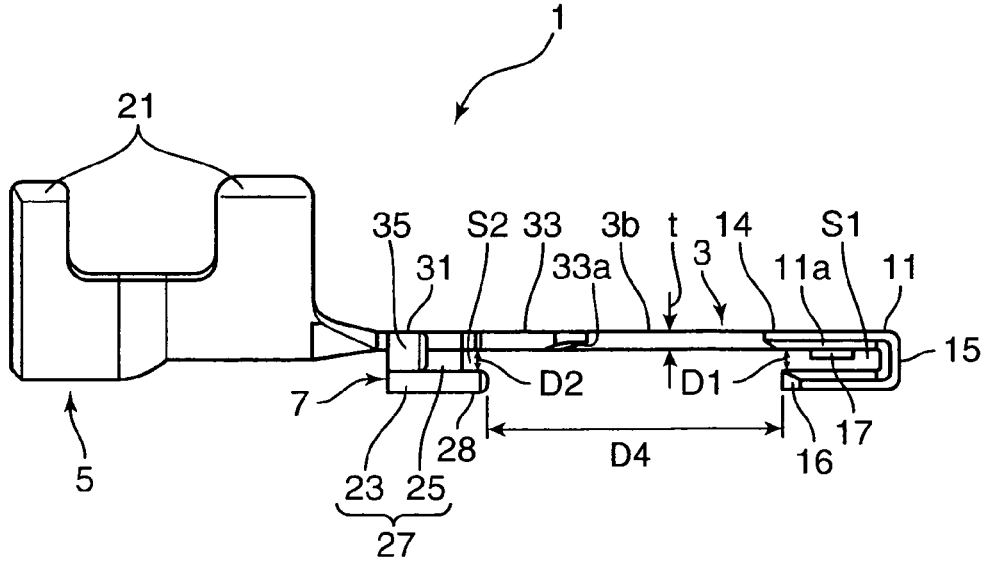
FIG. 2 is a side view of the ground terminal fitting shown in FIG. 1 from the side of a first clamping section.
Figure 3:
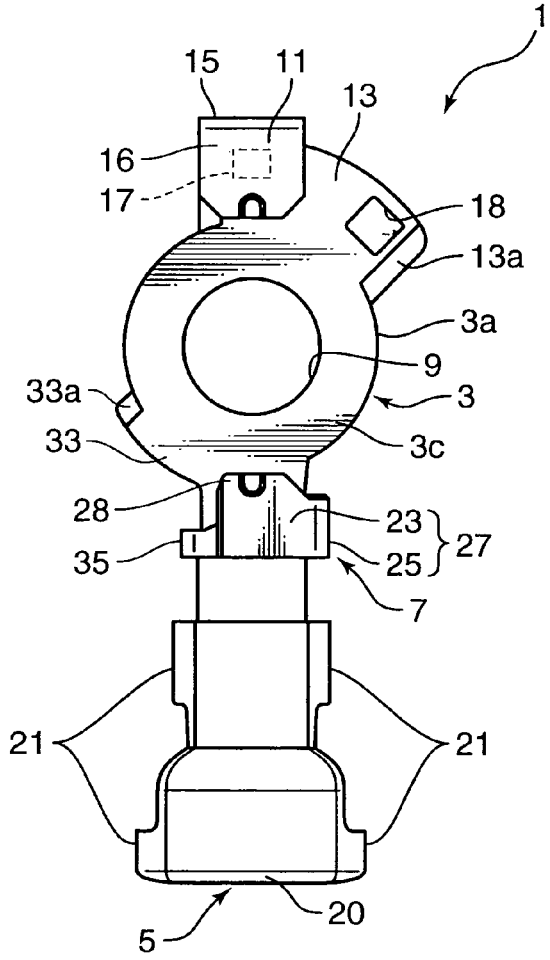
FIG. 3 is a bottom view of the ground terminal fitting shown in FIG. 1.

The first clamping piece 11 has a shape rising from the outer peripheral edge 3*a* in a direction opposite to a rising direction of after-mentioned barrel-shaped walls 21 of the cable crimp section 5, further having a distal end bent to extend along the terminal body 3. Specifically, as shown in the side view of FIG. 2, the first clamping piece 11 has: a base end portion 14 protruding radially outwardly from the outer peripheral edge 3*a* of the terminal body 3 on the same plane as that of the terminal body 3; a rising portion 15 rising from a distal edge 14*a* which is an protruding side (a right side in FIG. 2) edge of the base end portion 14, in a direction opposite to the rising direction of the after-mentioned barrel-shaped walls 21 of the cable crimp section 5, i.e., rising toward the side of a lower surface 3*c* of the terminal body 3; and a distal end portion 16 extending from a free edge of the rising portion 15 in parallel relation to the base end portion 14 and keeping a given distance with respect to the base end portion 14. The base end portion 14, the rising portion 15 and the distal end portion 16 define a space S1, and the distance D1 between the distal end portion 16 and the base end portion 14 is set to be approximately equal to a plate thickness t of the terminal body 3, that is, a plate thickness of the first clampable piece 13.

The base end portion 14 of the first clamping piece 11 is formed with a locking protrusion 17 protruding the distal end portion 16. The locking protrusion 17 is cut to be raised so as to protrude obliquely in a counterclockwise direction, when viewed from the side of an upper surface 3*b* of the terminal body 3. The first clamping piece 11 has opposite side edges, one edge 11*a* of the edges, on an opposite side of the first clampable piece 13, being obliquely cut away to have an inclined surface.

The first clampable piece 13 is formed with a locking hole 18. When a plurality of the ground terminal fittings 1 are superimposed on each other as described later, the locking hole 18 can be engaged with a locking protrusion 17 of a clamping piece 11 of another ground terminal fitting 1. The first clampable piece 13 has an edge 13*a*, which is obliquely cut away to have an inclined surface oriented toward the side of the lower surface 3*c* of the terminal body 3.

The cable crimp section 5 includes a bottom wall 20, and a pair of barrel walls 21 rising toward the side of the upper surface 3*b* of the terminal body 3, thus having an approximately U shape. The bottom wall 20 permits an end of a ground cable (not shown) to be set on the bottom wall 20: in this setting state, the pair of barrel-shaped walls 21 are plastically deformed so as to wrap around the end of the grounding cable, and thereby the cable crimp section 5 is fastened onto the end of the cable.

Figure 4:
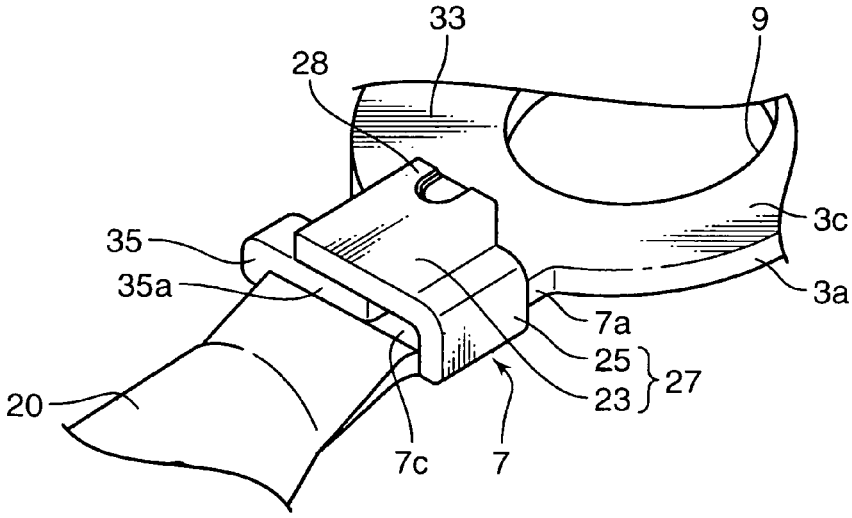
FIG. 4 is an enlarged bottom view showing a neck section of the ground terminal fitting in FIG. 1.

The neck section 7 is continued to a region of the outer peripheral edge 3*a* of the terminal body 3, which region is located on an opposite side of the first clamping piece 11, and the bottom wall 20 of the cable crimp section 5. FIG. 4 is a fragmentary enlarged bottom view showing the neck section 7 of the ground terminal fitting 1. From a side edge 7*a* of the neck section 7, there extends an extension segment 27, which has a distal end portion 23 bent so as to extend along a lower surface 7*c* of the neck section 7.

Specifically, the extension segment 27 has a rising portion 25 rising from the side edge 7*a* of the neck section 7, in a direction opposite to the rising direction of the barrel-shaped walls 21 of the cable crimp section 5, i.e., rising toward the side of the lower surface 3*c* of the terminal body 3, and a distal end portion 23 extending inwardly from a free edge of the rising portion 25 along the lower surface 7*c* of the neck section 7. The distal end portion 23 is formed with a jutting portion 28 which juts toward the through-hole 9 of the terminal body 3 in parallel relation to the lower surface 3*c* of the terminal body 3.

The extension segment 27 and the neck section 7 make up a second clamping piece (auxiliary clamping section) 31 adapted to clamp an after-mentioned second clampable piece (auxiliary clampable section) 33. The neck section 7 and the extension segment 27 define a space S2, wherein a distance D2 between the neck section 7 and the extension segment 27 is set to be approximately equal to the plate thickness t of the terminal body 3 or a plate thickness of a second clampable piece 33.

The second clampable piece 33 is formed along the outer peripheral edge 3*a* of the terminal body 3, and located on an opposite side of the first clampable piece 13. The second clampable piece 33 is formed to extend continuously from a side edge 7*b* of the neck section 7 on an opposite side of the side edge 7*a* connected to the extension segment 27, in the circumferential direction on the same plane as that of the terminal body 3, having a distal edge 33*a* which is obliquely cur away in a direction from the upper surface 3*b* to the lower surface 3*c* of the terminal body 3 to have an inclined surface oriented toward the side of the lower surface 3*c* of the terminal body 3.

Thus, the outer peripheral edge 3*a* of the terminal body 3 is continued to two sets of the clamping pieces 11, 31 and the clampable pieces 13, 33, while one set consisting of the first clamping piece 11 and the first clampable piece 13 and the other set consisting of the second clamping piece 31 and the second clampable piece 33 are disposed in opposed relation to each other at an interval of about 180 degrees in the circumferential direction of the terminal body 3.

From the neck section 7, further extends a superimposed segment 35. This superimposed segment 35 rises from the side edge 7*b* on the same side as that of the second clampable piece 33, in a direction opposite to the rising direction of the barrel-shaped wall 21. The superimposed segment 35 has a distal end portion 35*a* and is folded so as to superimpose the distal end portion 35*a* onto the lower surface 7*c* of the neck section 7. The superimposed segment 35 and the extension segment 27 are formed by folding the superimposed segment 35 in the above manner and thereafter folding the extension segment 27 so as to superimpose it onto the superimposed segment 35. The superimposed segment 35 and the extension segment 27 make up a reinforcing segment for improving strength of the neck portion 7.

Figure 5:
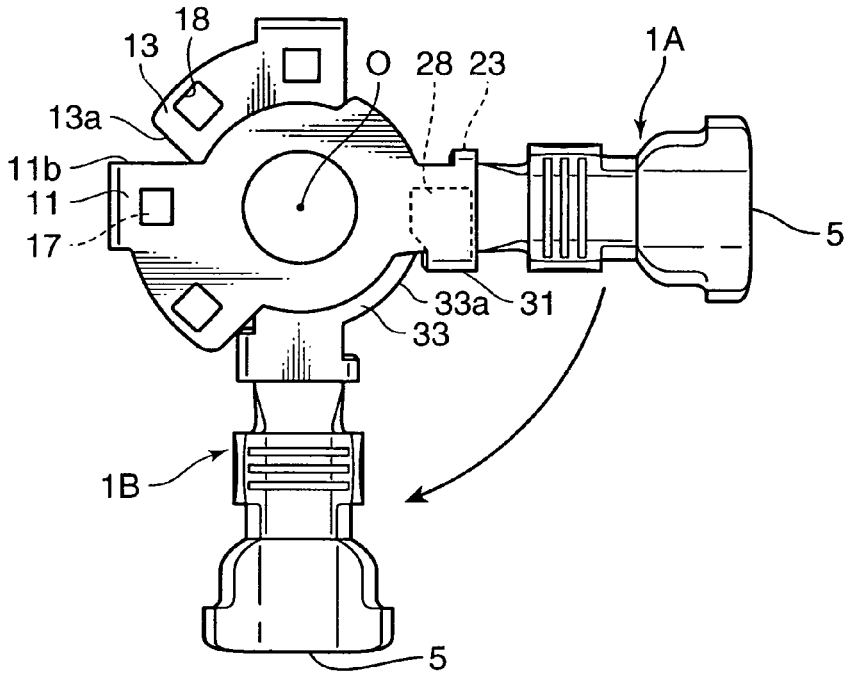
FIG. 5 is an explanatory diagram for explaining a process of superimposing a pair of the ground terminal fittings shown in FIG. 1, on each other, showing a state of respective terminal bodies of the ground terminal fittings superimposed on each other.
Figure 6:
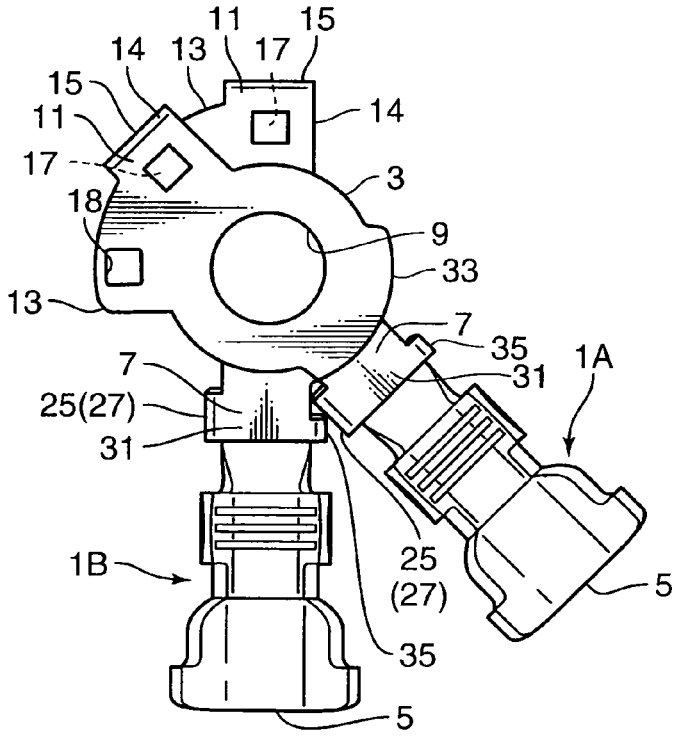
FIG. 6 is a top plan view showing a state of the ground terminal fittings superimposed on each other.
Figure 7:
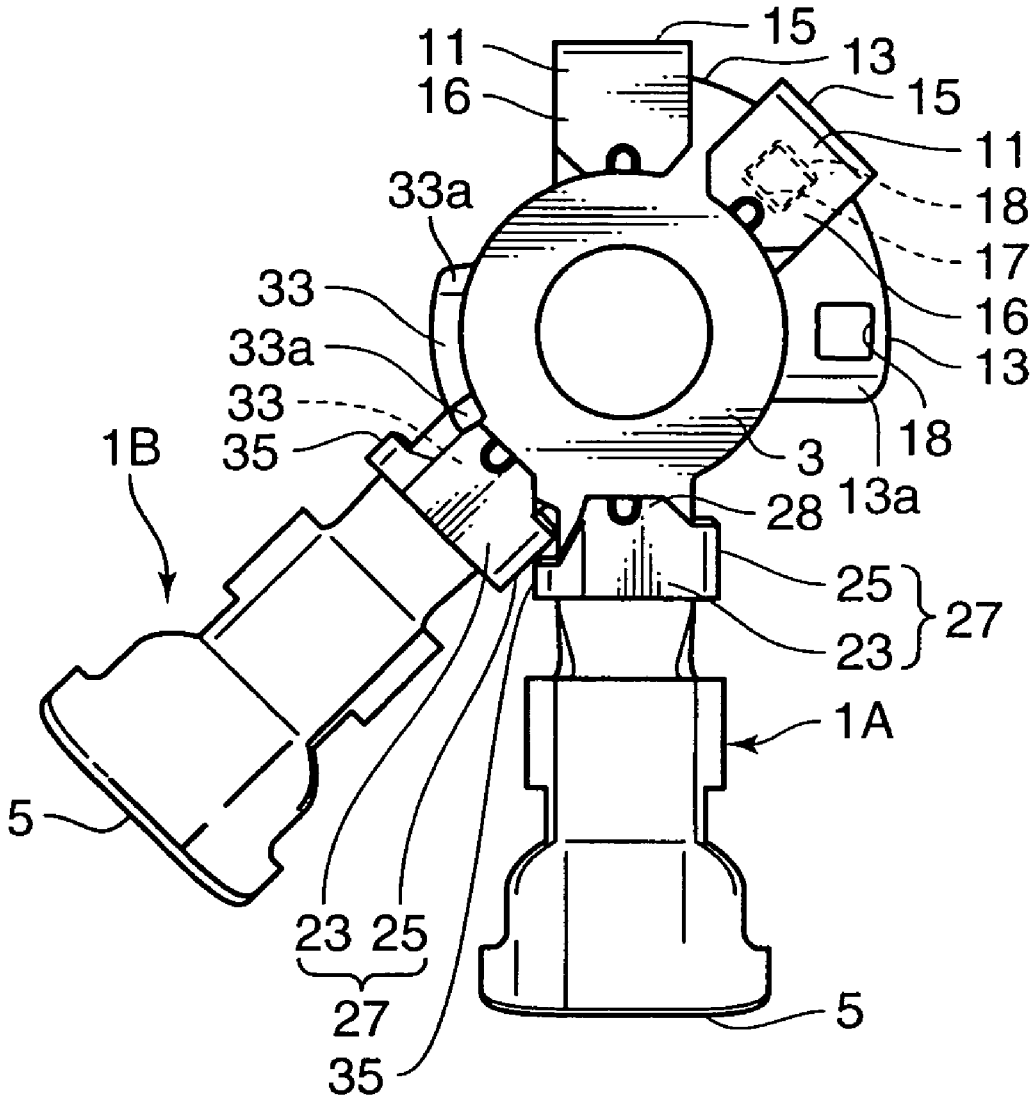
FIG. 7 is a bottom view showing the state of the ground terminal fittings superimposed on each other.

With reference to FIGS. 5 to 7, there will be described below a process of superimposing two ground terminal fittings 1A, 1B each having the same configuration as that of the aforementioned ground terminal fitting 1 to form a superimposed assembly. Firstly, as shown in FIG. 5, the terminal body 3 of the ground terminal fitting 1A is placed on the terminal body 3 of the ground terminal fitting 1B in a relative positional relationship where the two ground terminal fittings 1A, 1B are displaced by 90 degrees about a center O of the through-holes 9 thereof. In this state, the first clampable piece 13 of the lower ground terminal fitting 1B and the first clamping piece 11 of the upper ground terminal fitting 1A are located in adjacent relation to each other in the circumferential direction, and the second clampable piece 33 of the lower ground terminal fitting 1B and the second clamping piece 31 of the upper ground terminal fitting 1A are located in adjacent relation to each other in the circumferential direction.

Subsequently, the upper ground terminal fitting 1A is manually rotated in the direction indicated by the arrowed line, i.e., in a clockwise direction. Since each of the side edge 11*b* of the first clamping piece 11 and the locking protrusion 17 in the upper ground terminal fitting 1A, and the edge 13*b* of the first clampable piece 13 in the lower ground terminal fitting 1B is formed to have an inclined surface, the first clampable piece 13 can be smoothly fitted into the space S1 defined by the first clamping piece 11 even if the first clamping piece 11 of the upper ground terminal fitting 1A contacts the first clampable piece 13 of the lower ground terminal fitting 1B, thereby enabling the locking protrusion 17 of the first clamping piece 11 to be engaged with the locking hole 18 of the first clampable piece 13. Besides, since the edge 33*a* of the second clampable piece 33 of the lower ground terminal fitting 1B also has an inclined surface, the second clampable piece 33 can be smoothly fitted into the space S2 defined by the second clamping piece 31 even if the jutting portion 28 of the second clamping piece 31 of the upper ground terminal fitting 1A contacts the second clampable piece 33.

In short, as shown in FIGS. 6 and 7, the first clamping piece 11 of the upper ground terminal fitting 1A clamps the first clampable piece 13 of the lower ground terminal fitting 1B between the base end portion 14 and the distal end portion 16 thereof to prevent a relative displacement between the upper and lower ground terminal fittings 1A and 1B in an upward-downward direction, while the engagement between the locking protrusion 17 and the locking hole 18 prevents a relative circumferential displacement between the upper and lower ground terminal fittings 1A, 1B. In addition, as shown in FIG. 7, the second clamping piece 31 of the upper ground terminal fitting 1A clamps the second clampable piece 33 of the lower ground terminal fitting 1B between the neck section 7 and the jutting portion 28 of the extension segment 27, thus preventing a relative displacement between the upper and lower ground terminal fittings 1A, 1B in the upward-downward direction.

As above, the upper ground terminal fitting 1A and the lower ground terminal fitting 1B are superimposed on each other while being displaced by a given angle in the circumferential direction about the through-holes thereof, and connected to each other at two positions distant from each other in the circumferential direction by 180 degrees. This allows a superimposed assembly comprising the ground terminal fittings 1A, 1B to be formed.

Figure 8:
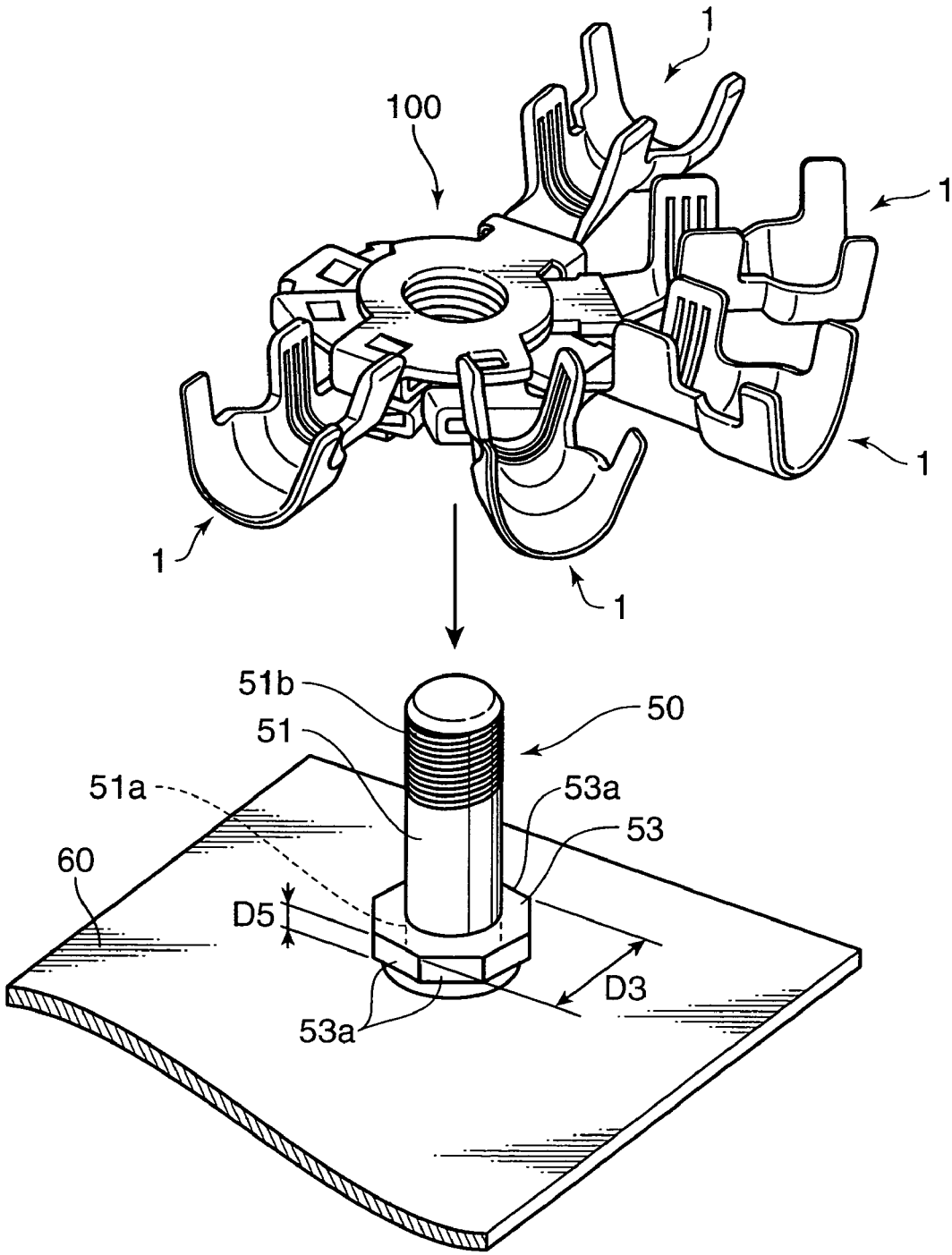
FIG. 8 is an explanatory diagram for explaining a process of fixing a superimposed assembly formed by assembling a plurality of the ground terminal fittings shown in FIG. 1 to a ground member.

FIG. 8 shows a superimposed assembly 100 formed by superimposing and connecting a plurality of the ground terminal fittings 1 together in the same manner as that described above. As shown in FIG. 8, this superimposed assembly 100 is fixed to the ground member 50 attached onto a support base 60, such as an automobile body.

The ground member 50 in this embodiment includes: a shaft portion 51 protruding from a surface of the support body 60; a fixed nut 53 which is fixed onto the support body 60 by welding or the like to serve as a rotation-blocking portion; and a fastening nut 55 (FIG. 10) serving as a fastening portion. The shaft portion 51 is composed of a stud bolt having opposite first and second ends 51*a*, 51*b* each formed with a screw groove: the first end 51*a* can be screwed into the fixed nut 53, and the fastening nut 55 can be screwed on the second end 51*b*.

The fixed nut 53 has an outer peripheral surface formed in a polygonal shape having a plurality of planar-shaped side surfaces 53*a* oriented in an outward direction, for example, 8-sided columnar shape. A distance D3 (FIG. 8) between two of the side surfaces 53*a* oriented in respective opposite directions is set to be approximately equal to a distance between the distal end portion 16 of the first clamping piece 11 and the extension segment of the second clamping piece 31 (shown in FIG. 2). Furthermore, a thickness D5 of the fixed nut 53 is set to be greater than either of the distance D1 between the distal end portion 16 and the base end portion 14 in the first clamping piece 11, and the distance D2 between the neck section 7 and the extension segment 27 in the second clamping piece 31.

The superimposed assembly 100 is fixed to the ground member 50 in the following manner.

Figure 9:
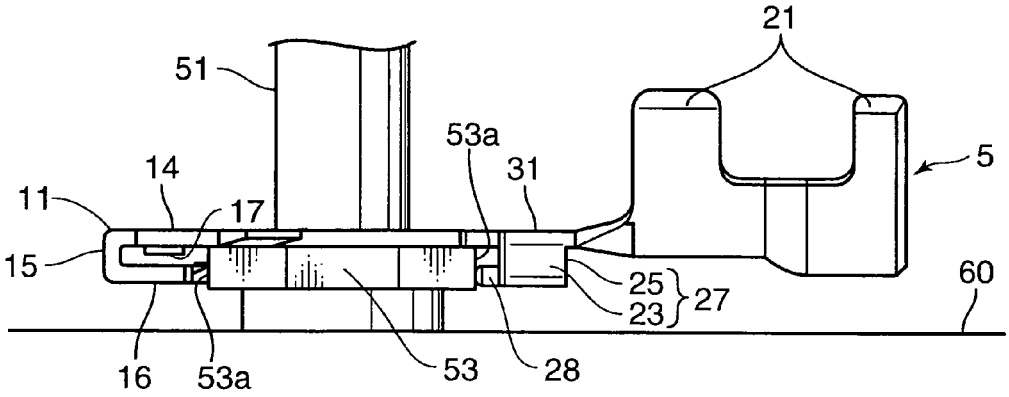
FIG. 9 is a view of an anti-rotation portion in a grounding-terminal-fitting fixing structure according to the present invention.

Firstly, the first end 51*a* of the shaft portion 51 is screwed into the fixed nut 53 fixed onto the support base 60, so that the shaft portion 51 is vertically installed on the support body 60. Then, the shaft portion 51 is inserted into the through-holes 9 of the ground terminal fittings 1 of the superimposed assembly 100 from the side of the second end 51*b* of the shaft portion 51, thus letting the superimposed assembly 100 be attached around the shaft portion 51. At this time, as shown in FIG. 9, the fixed nut 53 is fitted between the distal end portion 16 of the first clamping piece 11 and the extension segment 27 of the second clamping piece 31 in a lowermost one of the ground terminal fittings 1, thereby preventing a rotation of the lowermost ground terminal fitting 1 with respect to the ground member 50. This means that the fixed nut 53 serves as a rotation-blocking portion, which is so located on the support base 60 as to surround the shaft portion 51 to prevent a rotation of the lowermost ground terminal fitting 1.

Subsequently, as shown in FIG. 10, the fastening nut 55 is screwed on the second end 52*b* of the shaft portion 51 protruding beyond an uppermost one of the lowermost ground terminal fittings 1 of the superimposed assembly 100, and tightened. This makes the superimposed assembly 100 be fixed to the support base 60 while clamped between the fixed nut 53 and the fastening nut 55.

In the above manner, there is built up a ground device comprising the ground member 50 and the superimposed assembly 100 formed by superimposing the plurality of ground terminal fittings 1, in which device the ground terminal fittings 1 are kept from being rotated with respect to the support body 60, such as an automobile body. In FIG. 9, for ease of explanation, omitted is an illustration of the remaining ground terminal fittings other than the lowermost ground terminal fitting.

Moreover, in this embodiment, the shaft portion 51, which is fixed to the support base 60 such as an automobile body by means of screwing with the fixed nut 53, can be easily detached from the support body 60. This enables an operator assembling or repairing an automobile to be prevented from contacting the shaft portion 51 protruding upwardly from the support base 60.

The fastening nut 55 illustrated in FIG. 10, though having a flange, may be any type which is at least capable of being screwed with the second end 51*a* of the shaft portion 51. Furthermore, although FIG. 10 illustrates a washer 57 to be interposed between the fastening nut 55 and the terminal body 3 of the ground terminal fitting 1, the washer 57 can be omitted.

The ground terminal fitting 1 is permitted not to have the second clamping piece 31 and the second clampable piece 33. Even in this case, the first clamping piece 11 and the first clampable piece 13 can prevent a relative displacement between the ground terminal fittings 1. Furthermore, even without the second clamping piece 31, the first clamping piece 11 can prevent a rotation of the lowermost ground terminal fitting with respect to the ground member 50. Besides, contrary to the above embodiment where the locking protrusion is provided on the clamping piece 11 and the locking hole is provided in the clampable piece 13, the locking hole may be provided in the clamping piece 11, and the locking protrusion is provided on the clampable piece 13.

As described above, the present invention provides a ground terminal fitting designed to be fixed to a common ground member together with a second ground terminal fitting in a mutually superimposed manner, the ground terminal fitting comprising: an annular-shaped terminal body formed with a through-hole for allowing the ground member to penetrate therethrough; a cable-fastening section having a bottom wall, and a pair of barrel-shaped walls each rising from the bottom wall, the cable-fastening section being adapted to be fastened to an end of an electric cable based on plastic deformation of the pair of barrel-shaped walls; a clamping section having a rising portion rising from an outer peripheral edge of the terminal body in a direction opposite to that of the barrel-shaped walls of the cable-fastening section, and a distal end portion extending from the rising portion inwardly along the terminal body; and a clampable section formed along the outer peripheral edge to be located adjacent to the clamping section in a circumferential direction of the terminal body. The clamping section is adapted to clamp, when the ground terminal fitting is superimposed on a second ground terminal fitting, a clampable section of the second ground terminal fitting to prevent a relative displacement between the superimposed ground terminal fittings. The distal end portion of the clamping section is adapted to touch, when the ground member is set to penetrate through the through-hole, the ground member to prevent the ground terminal fitting having the clamping section from being rotated with respect to the ground member.

The present invention also provides a ground device which comprises a plurality of the above ground terminal fittings formed in a same configuration and adapted to be superimposed on each other to form a superimposed assembly, and a common ground member provided on a given support base and adapted to allow the superimposed assembly to be fixed thereto: the ground member has a portion adapted to be engaged with the clamping section of a lowermost one of the ground terminal fittings in the superimposed assembly to prevent a rotation of the lowermost ground terminal fitting.

In the ground terminal fitting and the ground device having the ground terminal fitting, the clamping section of the ground terminal fitting rises from the outer peripheral edge of the terminal body in the direction opposite to that of the pair of barrel-shaped walls, and can clamp, when the ground terminal fitting is located at a position other than a lowermost position, the clampable section of a second one of the ground terminal fittings located on a lower side thereof and in adjacent relation thereto, thus preventing a relative rotation between these ground terminal fittings. On the other side, the clamping section of the ground terminal fitting located at the lowermost position can prevent a rotation of the ground terminal fitting, based on engagement with the ground member. In this manner, the clamping section is used as both a member for preventing a relative rotation between the ground terminal fittings and a member for preventing a rotation of the ground terminal fitting located at the lowermost position, with respect to the ground member, thus allowing the ground device to be built up by use of only a single type of ground terminal fitting. This improves mass productivity to reduce cost, and eliminates a need for distinguishing types of ground terminal fittings to simplify an operation of attaching ground terminal fittings.

In a preferred embodiment of the present invention, one of the clamping section and the clampable section is formed with a locking protrusion protruding in the opposite direction, and the other section of the clamping section and the clampable section is formed with a locking hole which is adapted to be capable of being engaged, when the ground terminal fitting is superimposed on a second ground terminal fitting having a same configuration as that thereof, with the locking protrusion of the second ground terminal fitting. The engagement between the locking protrusion and the locking hole reliably prevents a relative displacement between the superimposed ground terminal fittings.

The ground terminal fitting according to more preferable embodiment of the present invention further comprises an auxiliary clamping section and an auxiliary clampable section each continued to the outer periphery of the annular-shaped terminal body and located on an opposite side of a corresponding one of the clamping section and the clampable section, wherein the auxiliary clamping section is adapted to cramp, when the clamping section clamps the clampable section of a second ground terminal fitting having a same configuration as that of the ground terminal fitting, the auxiliary clampable section of the second ground terminal fitting. The auxiliary clamping section and the auxiliary clampable section ensure prevention of a relative displacement between the superimposed ground terminal fittings; and a relative rotation of the ground terminal fitting with respect to the ground member.

The ground terminal fitting according to more preferable embodiment of the present invention further comprises a neck section connecting the terminal body and the cable-fastening section: the auxiliary clamping section has a rising portion rising from an edge of the neck section in a direction opposite to the rising direction of the barrel-shaped walls, and a distal end portion extending inwardly along the neck section and the auxiliary clampable section extends continuously from the neck section in the circumferential direction along the outer peripheral edge of the terminal body. The auxiliary clamping section, when the ground terminal fitting is superimposed on a second ground terminal fitting having a same configuration as that thereof, clamps the auxiliary clampable section of the second ground terminal fitting to prevent a relative displacement with respect to the second ground terminal fitting, and the extension segment of the auxiliary clamping section touches the ground member penetrating through the through-hole, thus preventing a rotation of the ground terminal fitting with respect to the ground member.

Since the auxiliary clamping section in the ground terminal fitting extends from the neck section and the auxiliary clampable section is continued to the neck section, the auxiliary clamping section and the auxiliary clampable section are less likely to interfere with those of the adjacent ground terminal fitting than an auxiliary clamping section and an auxiliary clampable section which would be separated from the neck section. This enables a larger number of ground terminal fittings to be superimposed on each other.

According to more preferable embodiment of the present invention, a superimposed segment extends from a part of the edge of the neck section on an opposite side of a remaining part of the edge connected to the extension segment: the superimposed segment is superimposed onto the neck section so as to extend between the neck section and the extension segment, thus constituting a reinforcing segment for reinforcing the neck section in cooperation with the extension segment. In this ground terminal fitting, the auxiliary clamping section used for preventing a relative displacement with respect to the second ground terminal fitting can also contribute to reinforcement of the neck section which is not likely to have a high strength as compared with the terminal body and the cable crimp section.

In a ground device according to a preferred embodiment of the present invention, the ground member includes: a shaft portion disposed to protrude from the support base and adapted to be inserted into the through-holes of the ground terminal fittings; a rotation-blocking portion located on the support base and around the shaft portion; and a fastening portion adapted to fasten the ground terminal fittings penetrated by the shaft portion, from the side of a distal end of the shaft portion, the rotation-blocking portion being adapted to engage with the clamping section of the lowermost ground terminal fitting to block a rotation of the lowermost ground terminal fitting. This allows a rotation of the ground terminal fitting with respect to the ground member to be prevented with a simple structure.

More preferably, the shaft portion is composed of a stud bolt having opposite ends each formed with a screw groove; the rotation-blocking portion is composed of a fixed nut fixed onto the support base and screwed with one of the ends of the stud bolt while receiving therein the one end; the fastening portion is composed of a fastening nut capable of being screwed with the other end of the stud bolt. The combination of the stud bolt and the nuts allow the shaft portion or the stud bolt to be attached to and detached from the support base with a simple structure.

Furthermore, if the fixed nut has an outer peripheral having a pair of plane side surfaces oriented in respective opposite directions, and a distance between the distal end portion of the clamping section and the distal end portion of the auxiliary clamping section is set to allow the fixed nut to be interposed between the respective distal end portion and to be approximately equal to a distance between the pair of planar-shaped side surfaces of the fixed nut, then the distal end portion of the clamping section and the distal end portion of the auxiliary clamping section can contact the respective side surfaces of the fixed nut from opposite directions to reliably prevent a rotation of the ground terminal fitting with respect to the ground member.

The invention claimed is:

1. A ground terminal fitting designed to be fixed to a common ground member together with a second ground terminal fitting in a mutually superimposed manner, comprising:

an annular-shaped terminal body formed with a through-hole for allowing the ground member to penetrate therethrough;

a cable-fastening section having a bottom wall, and a pair of barrel-shaped walls each rising from the bottom wall, the cable-fastening section being adapted to be fastened to an end of an electric cable based on plastic deformation of the pair of barrel-shaped walls;

a clamping section having a rising portion rising from an outer peripheral edge of the terminal body in a direction opposite to that of the barrel-shaped walls of the cable-fastening section, and a distal end portion extending from the rising portion inwardly along the terminal body; and a clampable section formed along the outer peripheral edge to be located adjacent to the clamping section in a circumferential direction of the terminal body, wherein the clamping section is adapted to clamp, when the ground terminal fitting is superimposed on the second ground terminal fitting, a clampable section of the second ground terminal fitting to prevent a relative displacement between the superimposed ground terminal fittings, and the distal end portion of the clamping section is adapted to touch the ground member, when the ground member is set to penetrate through the through-hole, to prevent the ground terminal fitting having the clamping section from being rotated with respect to the ground member.

2. The ground terminal fitting as defined in claim 1, wherein:

one of the clamping section and the clampable section is formed with a locking protrusion protruding toward the other; and the other section of the clamping section and the clampable section is formed with a locking hole which is adapted to be capable of being engaged, when the ground terminal fitting is superimposed on a second ground terminal fitting having a same configuration as that thereof, with the locking protrusion of the second ground terminal fitting.

3. The ground terminal fitting as defined in claim 1, which further comprises an auxiliary clamping section and an auxiliary clampable section each continued to the outer periphery of the annular-shaped terminal body and located on an opposite side of a corresponding one of the lamping section and the clampable section, the auxiliary clamping section being adapted to cramp, when the clamping section clamps the clampable section of a second ground terminal fitting having a same configuration as that of the ground terminal fitting, the auxiliary clampable section of the second ground terminal fitting.

4. The ground terminal fitting as defined in claim 3, which further comprises a neck section connecting the terminal body and the cable-fastening section, wherein:

the auxiliary clamping section has a rising portion rising from an edge of the neck section in a direction opposite to the rising direction of the barrel-shaped walls, and a distal end portion extending inwardly along the neck section; and the auxiliary clampable section extends continuously from the neck section in the circumferential direction along the outer peripheral edge of the terminal body, and wherein:

the auxiliary clamping section is adapted to clamp, when the ground terminal fitting is superimposed on a second ground terminal fitting having a same configuration as that thereof, the auxiliary clampable section of the second ground terminal fitting to prevent a relative displacement with respect to the second ground terminal fitting; and the extension segment of the auxiliary clamping section is adapted to touch the ground member penetrating through the through-hole to prevent a rotation of the ground terminal fitting with respect to the ground member.

5. The ground terminal fitting as defined in claim 4, which further comprises a superimposed segment extending from a part of the edge of the neck section on an opposite side of a remaining part of the edge connected to the extension segment, the superimposed segment being superimposed onto the neck section to extend between the neck section and the extension segment to make up a reinforcing portion which reinforces the neck section in cooperation with the extension segment.

6. A ground device comprising a plurality of ground terminal fittings formed in a same configuration and adapted to be superimposed on each other to form a superimposed assembly, and a common ground member being provided on a given support base and having a portion adapted to be inserted into respective through-holes of the ground terminal fittings included in the superimposed assembly, wherein:

each of the ground terminal fittings is comprised of the ground terminal fitting as defined in claim 1; and the ground member has a portion adapted to be engaged with the clamping section of a lowermost one of the ground terminal fittings in the superimposed assembly to prevent a rotation of the lowermost ground terminal fitting.

7. The ground device as defined in claim 6, wherein the ground member includes: a shaft portion disposed to protrude from the support base and adapted to be inserted into the through-holes of the ground terminal fittings; a rotation-blocking portion located on the support base and around the shaft portion; and a fastening portion adapted to fasten the ground terminal fittings penetrated by the shaft portion, from the side of a distal end of the shaft portion, and wherein the rotation-blocking portion is adapted to engaged with the clamping section of the lowermost ground terminal fitting to block a rotation of the lowermost ground terminal fitting.

8. The ground device as defined in claim 7, wherein:

the shaft portion is comprised of a stud bolt having opposite ends each formed with a screw groove;

the rotation-blocking portion is comprised of a fixed nut fixed onto the support base and screwed with one of the ends of the stud bolt while receiving therein the one end; and the fastening portion is comprised of a fastening nut capable of being screwed with the other end of the stud bolt.

9. A ground device comprising a plurality of ground terminal fittings formed in a same configuration and adapted to be superimposed on each other to form a superimposed assembly, and a common ground member being provided on a given support base and having a portion adapted to be inserted into respective through-holes of the ground terminal fittings included in the superimposed assembly, wherein:

each of the ground terminal fittings is comprised of the ground terminal fitting as defined in claim 3; and the ground member includes a stud bolt disposed to protrude from the support base and adapted to be inserted into the through-holes of the ground terminal fittings, a fixed nut fixed onto the support base and screwed with one of opposite ends of the stud bolt while receiving therein the one end, and a fastening nut adapted to be capable of being screwed with the other end of the stud bolt to fasten the ground terminal fittings on the shaft portion inserted therein, from the side of a distal end of the shaft portion, and wherein:

the fixed nut has an outer peripheral surface having a pair of plane side surfaces oriented in respective opposite directions; and a distance between the distal end portion of the clamping section and the distal end portion of the auxiliary clamping section is set to allow the fixed nut to be interposed between the respective distal end portion and to be approximately equal to a distance between the pair of planar-shaped side surfaces of the fixed nut.

* * * * *